US008033357B2

(12) United States Patent
Nishijima

(10) Patent No.: US 8,033,357 B2
(45) Date of Patent: Oct. 11, 2011

(54) EXHAUST SYSTEM FOR A MOTORCYCLE, AND MOTORCYCLE INCORPORATING SAME

(75) Inventor: Tomoki Nishijima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 383 days.

(21) Appl. No.: 12/288,964

(22) Filed: Oct. 24, 2008

(65) Prior Publication Data

US 2009/0114477 A1 May 7, 2009

(30) Foreign Application Priority Data

Nov. 2, 2007 (JP) ..... 2007-286184

(51) Int. Cl.
*B60K 13/04* (2006.01)

(52) U.S. Cl. ..... 180/296; 180/309

(58) Field of Classification Search ..... 180/219, 180/296, 309, 89.2, 68.3; 181/238, 248, 181/216, 239, 241, 243, 240, 252, 228; 60/313, 60/312, 287, 324
See application file for complete search history.

(56) References Cited

U.S. PATENT DOCUMENTS

| | | | | |
|---|---|---|---|---|
| 4,809,800 | A | 3/1989 | Suzuki | |
| 4,896,504 | A * | 1/1990 | Matsui | 60/313 |
| 6,745,863 | B2 * | 6/2004 | Tsukui et al. | 180/309 |
| 7,347,045 | B2 * | 3/2008 | Bozmoski et al. | 60/312 |
| 7,364,010 | B2 * | 4/2008 | Konno | 181/228 |
| 7,540,347 | B2 * | 6/2009 | Taniguchi et al. | 180/219 |
| 7,559,393 | B2 * | 7/2009 | Horii et al. | 180/89.2 |
| 7,686,122 | B2 * | 3/2010 | Nakayama | 180/296 |
| 7,699,134 | B2 * | 4/2010 | Terashima et al. | 180/309 |
| 2006/0201742 | A1 | 9/2006 | Terashima et al. | |

FOREIGN PATENT DOCUMENTS

| | | |
|---|---|---|
| EP | 1 701 009 A1 | 9/2006 |
| JP | 56-135708 A | 10/1981 |
| JP | 57-008310 A | 1/1982 |
| JP | 61-138814 A | 6/1986 |
| JP | 2007-091180 | 4/2007 |

* cited by examiner

*Primary Examiner* — Hau Phan
(74) *Attorney, Agent, or Firm* — Carrier Blackman & Associates, P.C.; Joseph P. Carrier; William D. Blackman

(57) ABSTRACT

An exhaust system for a motorcycle includes exhaust pipes extending from exhaust ports of an engine, a first muffler chamber for receiving the exhaust pipes, a second muffler chamber arranged parallel to and operatively connected with the first muffler chamber, and a silencer disposed in the second muffler chamber. The exhaust system is distributively arranged in a vehicle width direction such that the first muffler chamber is situated on a left side of a center line of the motorcycle defined along longitudinal direction of the motorcycle, and the second muffler chamber is situated on a right side of the center line. The first and second muffler chambers are disposed at a position below the engine. The exhaust gas from the engine is emitted outside the engine via, in sequence, the exhaust pipes, the first and second muffler chambers and the silencer.

16 Claims, 4 Drawing Sheets

EXHAUST SYSTEM FOR A MOTORCYCLE, AND MOTORCYCLE INCORPORATING SAME

CROSS-REFERENCE TO RELATED APPLICATIONS

The present application claims priority under 35 USC §119 based on Japanese patent application No. 2007-286184, filed on Nov. 2, 2007. The entire subject matter of this priority document is incorporated by reference herein.

BACKGROUND OF THE INVENTION

1. Field of the Invention

The present invention relates to an exhaust system for a motorcycle, and to a motorcycle incorporating same. More particularly, the present invention relates to a distributive arrangement of components of the exhaust system in a motorcycle.

2. Description of the Background Art

There are several known exhaust systems for a motorcycle. The exhaust systems emit exhaust gas from an engine into the air via an exhaust pipe and a silencer. The engine is generally arranged between front and rear wheels of the motorcycle.

An example of such known exhaust system for a motorcycle is disclosed in the Japanese Patent document JP-A No. 2007-91180, in which a first muffler (54) and a second muffler (55) are arranged parallel to each other at a position below the engine, and in which an exhaust pipe extending from the engine is connected to the second muffler (see FIGS. 1 and 4 thereof).

According to the Japanese Patent document JP-A No. 2007-91180 (as shown in the FIG. 4 thereof), the exhaust system includes a plural (four) exhaust pipes (39A to 39D) extending in a longitudinal direction of a vehicle body. The exhaust pipes (39A-39D) are connected to the second muffler (55) at rear portion thereof via a U-shaped bent second connecting pipe (52), and are operatively connected to the first muffler (54) via a front end portion of the second muffler (55). The second muffler (55) is arranged in the longitudinal direction of the vehicle body. The first muffler (54) is arranged in series with the second muffler (55) in the longitudinal direction of the vehicle body.

A downstream portion (a portion in front of the U-shaped portion of the bent second connecting pipe in the rear of the vehicle body) of the first muffler 54 communicates with an expansion chamber 69. The second connecting pipe (52) is connected to a third muffler 57 (see FIG. 1 of the Japanese Patent document JP-A No. 2007-91180) arranged in the rear of the vehicle body.

The exhaust system, as disclosed in the Japanese Patent document JP-A No. 2007-91180 (see FIG. 4 thereof), is configured such that the exhaust pipes 39A-39D and connecting pipe (52) are arranged on one side (right side) of the vehicle body in a vehicle width direction, whereas the first muffler and the second muffler, each respectively having large volume, are arranged in series on the other side (left side) of the vehicle body in the vehicle width direction.

Since the exhaust pipes and connecting/collecting pipes are arranged on one side and the mufflers (having large volumes) are arranged on the other side, the length of the exhaust system in a longitudinal direction of the vehicle is disadvantageously lengthened (increased), particularly when the exhaust system is arranged below the engine of the motorcycle, the length of the exhaust system is further increased.

As a result of increasing a length of the exhaust system, arranged below the engine in the longitudinal direction of the vehicle, a wheelbase of the motorcycle is disadvantageously increased.

The present invention has been made to overcome such drawbacks of the existing exhaust system for the motorcycle. Accordingly, it is one of the objects of the present invention to provide an exhaust system for a motorcycle, in which the exhaust system is arranged below the engine, and in which components of the exhaust system are arranged such that a length of the exhaust system is reduced in comparison to the existing systems so as to achieve a lateral balance of the exhaust system in a vehicle width direction, and to enable the concentration of the mass of the exhaust system at a desired position.

SUMMARY OF THE INVENTION

In order to achieve the above objects, the present invention according to a first aspect thereof provides an exhaust system for a motorcycle having an engine arranged between front and rear wheels thereof. The engine includes exhaust ports formed therein, and connected to respective exhaust pipes extending therefrom for emitting exhaust gas outside the engine via a silencer operatively connected to the exhaust pipes.

The exhaust system includes a first muffler chamber, a second muffler chamber, and the silencer. The first muffler chamber is situated between the engine and the rear wheel at a position below the engine. The exhaust pipes extending from exhaust ports of the engine converge in the first muffler chamber; and the exhaust gas from the engine flows in the first muffler chamber via the exhaust pipes. The second muffler chamber is arranged substantially parallel to the first muffler chamber in a vehicle width direction at a position below the engine, and into which the exhaust gas from the first muffler chamber flows.

The silencer is situated in a rear of the second muffler chamber in a longitudinal direction of a vehicle body, and into which the exhaust gas from the second muffler chamber flows, and from which the exhaust gas is emitted outside the engine.

The present invention according to a second aspect thereof, in addition to the first aspect, is characterized in that the exhaust gas flows into the second muffler chamber from the rear portion of the first muffler chamber in the vehicle width direction, then flows forwardly in the longitudinal direction of the vehicle body in the second muffler chamber, and is turned back at front inside portion in the longitudinal direction of the second muffler chamber, and further flows rearwardly in the longitudinal direction of the body, and subsequently flows into front portion of the silencer in the longitudinal direction of the vehicle body, and finally, is emitted outside the exhaust system from the rear of the silencer.

The present invention according to a third aspect thereof, in addition to the first aspect, is characterized in that the plural exhaust pipes are inserted into the first muffler chamber and are unified therein, and a catalyst is arranged at a junction where the plural exhaust pipes, and exhaust gas therefrom is merged (unified).

The present invention according to a fourth aspect thereof, in addition to the first aspect, is characterized in that that the first muffler chamber and the second muffler chamber are arranged distributively at the left and right sides of a center line (formed along a longitudinal direction of the vehicle) in the vehicle width direction.

EFFECTS OF THE INVENTION

In the present invention according to the first aspect—since the exhaust pipes converge below the engine and connected to the first muffler chamber, the second muffler chamber disposed parallel to the first muffler chamber, the silencer is arranged in the rear of the body of the second muffler chamber in the longitudinal direction, the exhaust gas from the second muffler chamber flows into the silencer, and is emitted outside—the length of the exhaust pipes and that of the silencer can be possibly reduced by securing the length of the exhaust pipes and by first arranging the muffler chambers parallel to the right and left. Accordingly, the length of the exhaust system including the silencer is reduced. As a result, the wheelbase of the motorcycle can be reduced.

Besides, since the first muffler chamber and the second muffler chamber are arranged parallel to each other, the mass of the exhaust system arranged below the engine is centralized. Accordingly, a balanced exhaust system arranged below the engine can be acquired.

Further, in the present invention, since the first muffler chamber and the second muffler chamber are arranged parallel to each other, the lateral width of each of the muffler chambers can be increased, while reducing the longitudinal length thereof, as described above. Therefore, height of each of the muffler chambers can be decreased (inhibited) without compromising capacity of the muffler chambers. Also, since the height of the muffler chamber is decreased, the minimum road clearance can be sufficiently secured while arranging the exhaust system below the engine.

In the present invention according the second aspect thereof, in addition to the first aspect—since exhaust gas flows into the rear of the second muffler chamber in the vehicle width direction, and then flows in the longitudinal direction of the vehicle body in the second muffler chamber, which then turned back in the front in the longitudinal direction of the body of the second muffler chamber and flows rearwardly in the longitudinal direction of the body, and then flows into the silence from a front portion thereof in the longitudinal direction of the vehicle body and is subsequently, emitted outside the exhaust system from the rear of the silencer—the length of the exhaust pipes can be reduced while securing the required sufficient volume of the exhaust system piping for treating and emitting exhaust gas from the engine. Also, efficiency of the exhaust system can be increased providing excellent output. Further, desired silencing effects for the exhaust system can be acquired.

In the present invention according the third aspect thereof, since the plural exhaust pipes are inserted into the first muffler chamber and are unified therein, and since the catalyst is arranged in the junction (or vicinity thereof) where the plural pipes are connected, the mass below the engine can be centralized.

In the present invention according to the fourth aspect thereof, since the first muffler chamber and the second muffler chamber are arranged distributively at the left and right sides (of the center line along the longitudinal direction) in the vehicle width direction—effective balance in the lateral arrangement of the exhaust system is achieved.

Also, with such arrangement of the muffler chambers, i.e., by distributively arranging the first muffler chamber and the second muffler chamber at the left and right in the vehicle width direction, the lateral width (along the vehicle width direction) of each of the muffler chambers can be increased thereby reducing the longitudinal length of each muffler chamber, as described above. Accordingly, an entire height of each of muffler chambers can be inhibited (reduced) while securing sufficient capacity for each of the muffler chambers. Also, a desirable minimum road clearance can be effectively secured even when the exhaust system is arranged below the engine.

DETAILED DESCRIPTION OF ILLUSTRATIVE EMBODIMENTS

Figure 1:
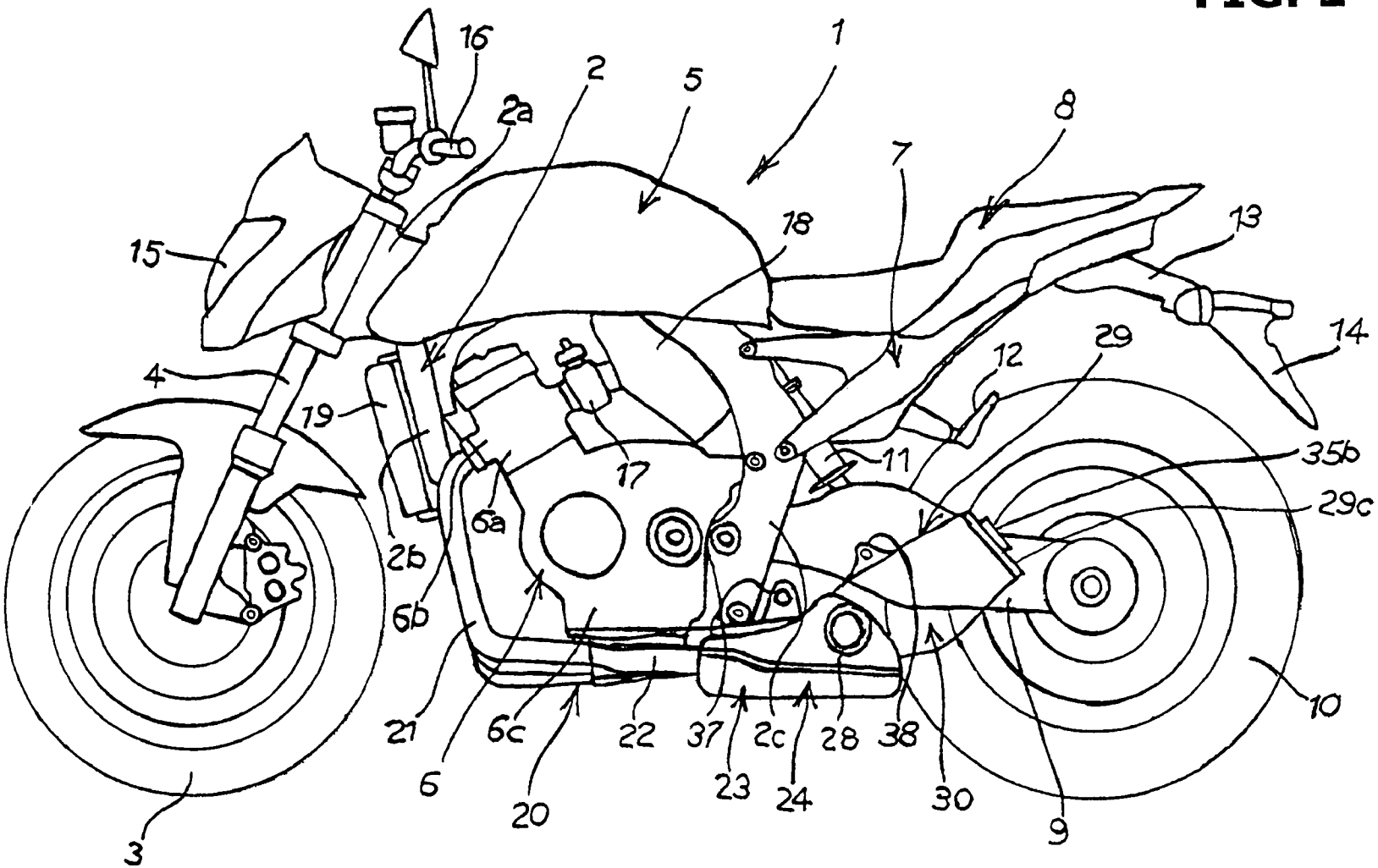
FIG. 1 is a schematic side view showing a motorcycle having an exhaust system according to the present invention.

It should be understood that only structures considered necessary for illustrating selected embodiments of the present invention are described herein. Other conventional structures, and those of ancillary and auxiliary components of the system, will be known and understood by those skilled in the art.

An illustrative embodiment of the present invention is described below with reference to the attached drawings. In the drawings, Fr denotes a front traveling direction of a vehicle, Rr denotes the rear direction opposite to the front traveling direction, R denotes the right side based upon a rider's position, while normally operating the vehicle, and L denotes the left side based upon the rider's position.

FIG. 1 is a schematic side view of a motorcycle 1 having an exhaust system 20 according to the present invention.

In the motorcycle 1, a front wheel 3 is steerably supported by a front fork 4 on the downside of a head pipe 2*a* at a front end of a frame 2, a fuel tank 5 is arranged on/over a front half portion of the frame 2, a rear frame 2*c* is suspended from an intermediate portion in a longitudinal direction, and an engine 6 is arranged between a down tube 2*b* and a rear frame 2*c*. The engine 6 is a water-cooled, in-line four-cylinder engine, and includes plural cylinders 6*a* arranged in line in a vehicle width direction.

A seat rail 7 having a V-shaped end portion is extended rearwardly from an upper intermediate portion of the rear frame 2*c*. The seat rail 7 supports a tandem seat 8, as shown in FIG. 1. A rear swing arm 9 that supports a rear wheel 10 is rockably fastened to a center of a lower portion of the rear frame 2*c*, and is extended rearwardly therefrom.

A rear cushion unit (shock absorber) 11 is disposed between the rear swing arm 9 and the frame 2. A pillion step 12 for a passenger is provided on the seat rail 7. The seat rail 7 includes right and left members. A rear fender 13 is extended from a rear end of the seat rail 7, and lighting equipments such as right and left blinkers, and a license lamp and an end plate 14 that supports a license plate are extended from rear portion of the rear fender.

Further, as shown in FIG. 1, the motorcycle includes a headlight 15, a handlebar 16, a fuel supply equipment 17 such as a carburetor arranged at rear of the cylinders 6*a* of the engine, an air cleaner 18, and a radiator 19.

The details of the exhaust system 20, shown in FIG. 1, are discussed with reference to FIGS. 3 and 4, herein below.

Figure 3:
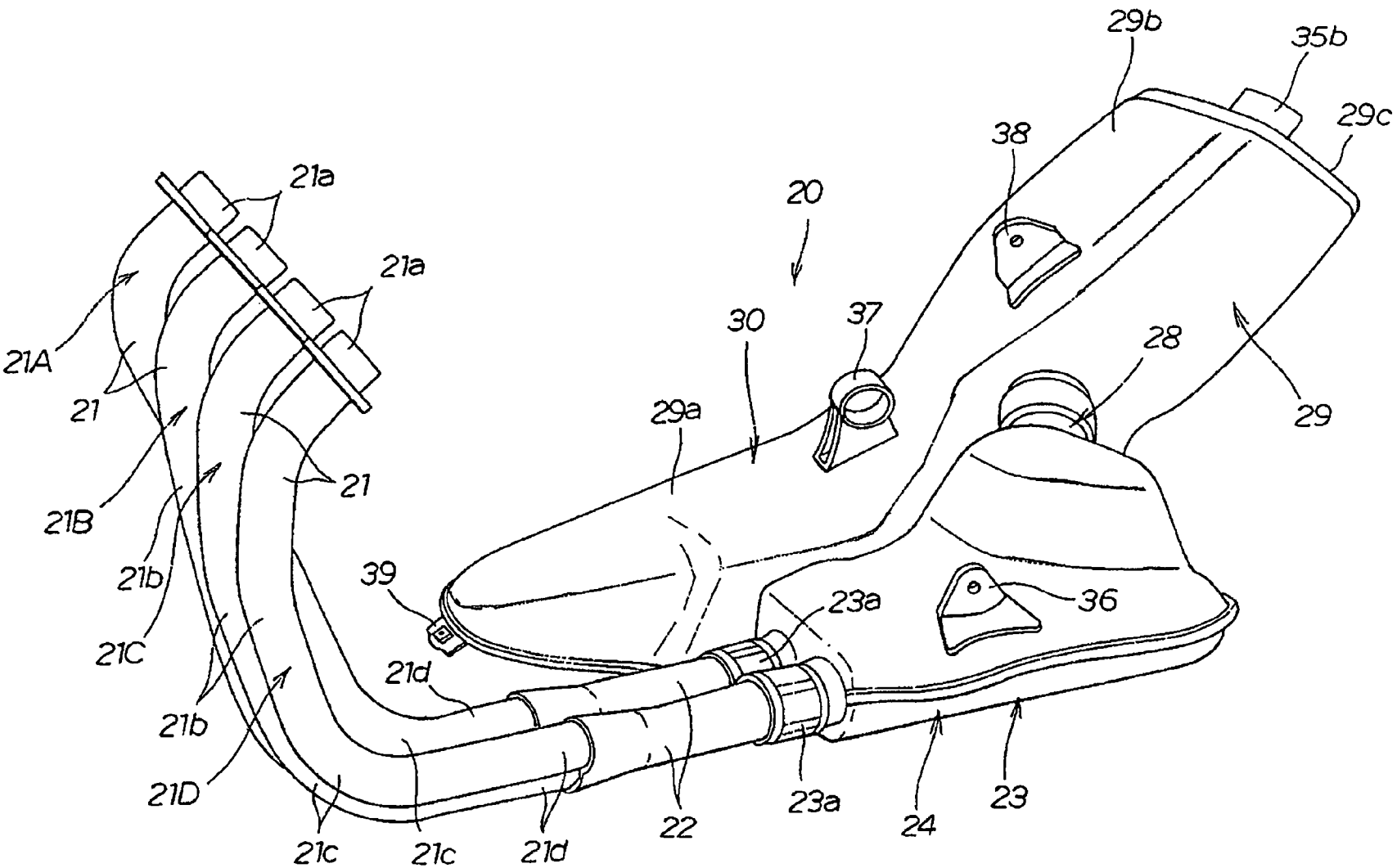
FIG. 3 is a perspective view showing the exhaust system of the present invention.
Figure 4:
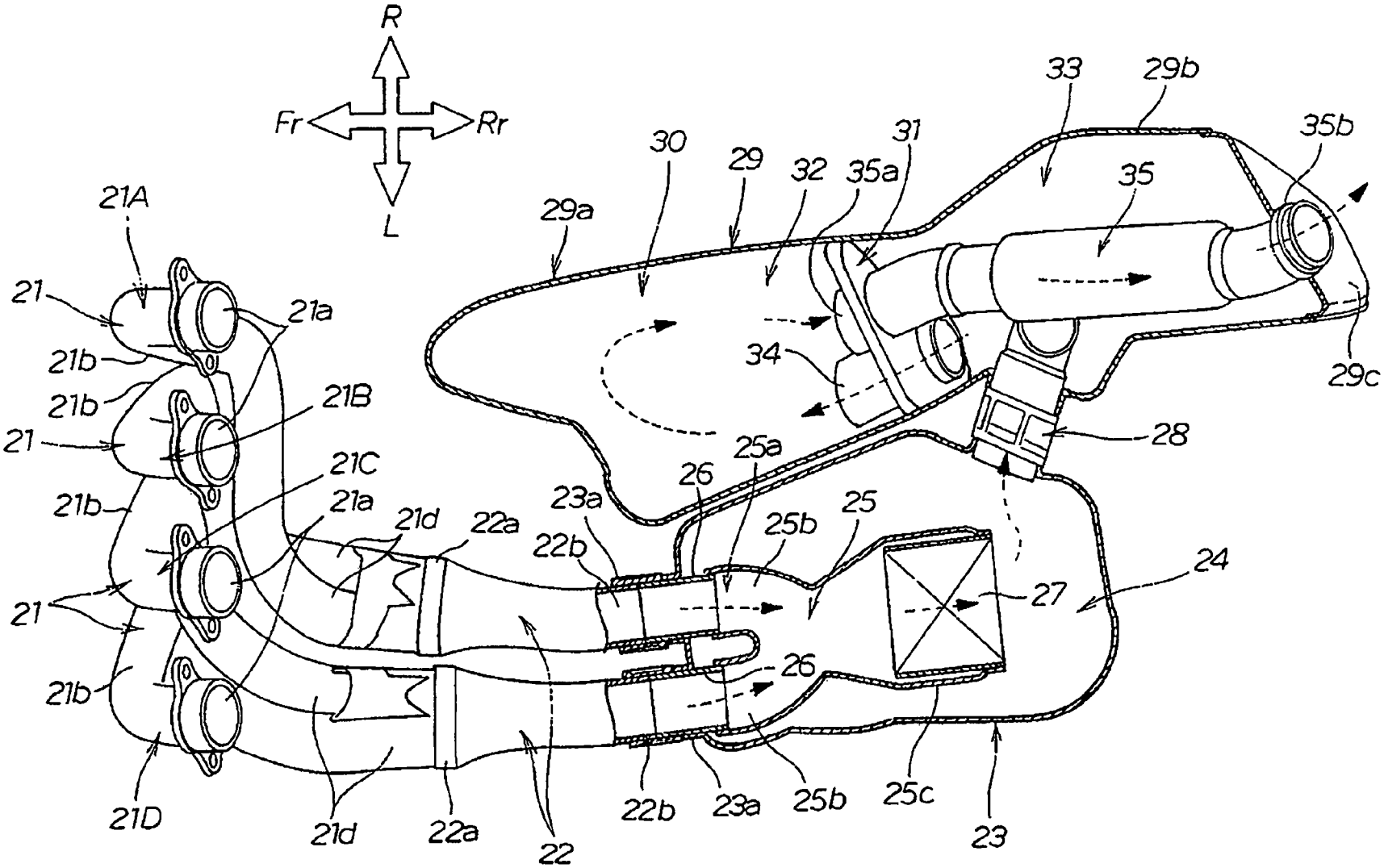
FIG. 4 is a plan view showing the cross section of the exhaust system of the present invention.

FIG. 3 is a perspective view showing the exhaust system 20, and FIG. 4 is a representative cross-sectional view of the exhaust system 20.

As shown in FIGS. 3 and 4, the exhaust system 20 includes a plurality of exhaust pipes 21 connected to respective exhaust ports 6*b* of the cylinders 6*a* of the engine 6. Four exhaust pipes 21 for the four-cylinder engine are shown in the illustrative embodiment of the present invention. When viewed in a side view, each of the exhaust pipes 21 has a shape such that a front half portion 21*b* thereof is extended downwardly and frontwardly from the engine from each of respective inlets 21*a* of the exhaust pipes. The inlets 21 receive exhaust gas from the engine. When viewed in a side view, a lower portion 21*c* of each of the exhaust pipes is bent rearwardly in a substantially L-shaped form.

Further, as shown in FIGS. 3 and 4, two each of the four exhaust pipes 21 are bundled in at downstream portion 21*d* thereof so as to form two junction pipes 22. The diameter of each upstream portion 22*a* of each of the junction pipes 22 is greater than a diameter of the downstream portion 21*d* of each of the exhaust pipes 21 because each upstream portion 22*a* of each of the junction pipes 22 includes the downstream portions 21*d* of the two exhaust pipes 21. The diameter of the downstream portion 21*d* of each junction pipe 22 is less than the diameter of the upstream portion thereof.

As the inlets 21*a* in uppermost portions (at upper ends) of the four exhaust pipes 21 are connected to the exhaust ports 6*b* arranged in line in a lateral direction of the four cylinders of the engine, the inlets are distributively arranged such that they are situated to the right and left in the vehicle width direction.

In the illustrative embodiment, as shown in FIG. 4, the rightmost exhaust pipe 21A, the intermediate exhaust pipes 21B, 21C and the leftmost exhaust pipe 21D are arranged in a line and disposed apart laterally. When viewed in a top view, the front half portion 21*b* of the each of exhaust pipes 21 is bent leftwardly. The lower portion 21*c* and the downstream portion 21*d* of each of the exhaust pipes 21 are arranged on the left side in the vehicle width direction, and are biased towards the left side of the motorcycle.

The junction pipes 22 are respectively fitted in two inlets 23*a* of a first muffler 23. The inlets 23*a* are provided at an upstream portion of the first muffler 23. The first muffler 23 is wider in a horizontal plane and is relatively shorter in length. The vertical dimension (height) of the first muffler is relatively shorter compared to conventional mufflers. The first muffler 23 has a first muffler chamber 24 formed therein. The first muffler chamber 24 has a predetermined volume.

The first muffler 23 having the first muffler chamber 24 formed therein is arranged on the left side (in the vehicle width direction) of the center line CL. The first muffler 23 is biased, as shown in FIG. 4.

An exhaust gas guidance section 25 is located in a middle portion in a lateral direction of an intermediate and an upstream portion of the first muffler chamber 24. The exhaust gas guidance section 25 includes an upstream portion 25*a* formed of a yoked-type guidance portions 25*b*. The guidance portions 25*b* are U-shaped, when viewed in a top view. The guidance portions 25*b* are connected to downstream ends of the two junction pipes 22 via connecting pipes 26.

The exhaust gas guidance section 25 immediately at upstream side of the yoked type guidance portions 25*b* is slightly narrowed. The exhaust gas guidance section 25 at downstream side thereof is widened forming a widened portion 25*c*. A catalyst 27 is arranged in the widened portion 25*c* of the exhaust gas guidance section 25.

Accordingly, exhaust gas flowing via the exhaust pipes 21 flows into the guidance section 25 through the junction pipes 22. The exhaust gas is purified by the catalyst 27 in a downstream portion of the guidance section 25, and subsequently, flows towards the downstream side (towards rearward side of the longitudinal direction) of the voluminous first muffler chamber 24.

Figure 2:
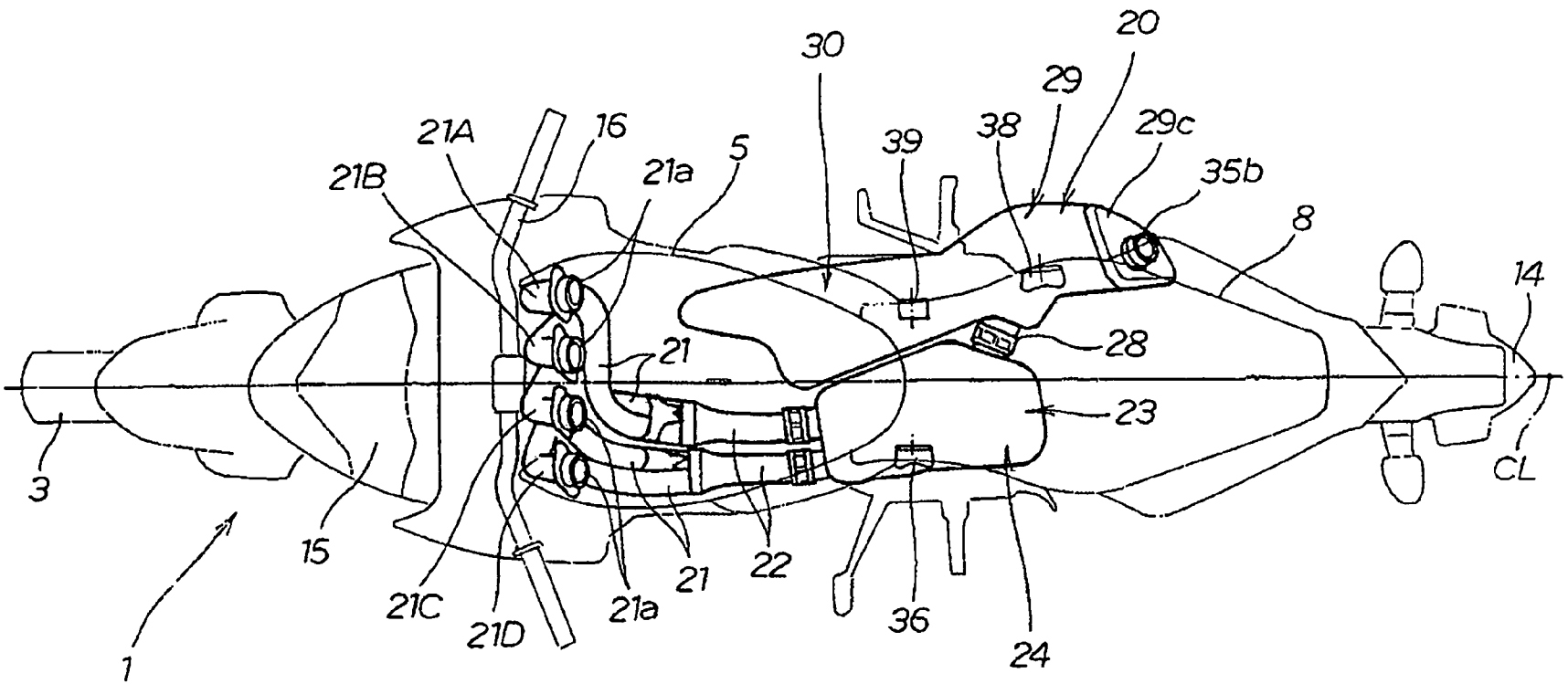
FIG. 2 is a schematic top plan view showing the exhaust system of the motorcycle, in which the exhaust system is shown by a thick full line, and a visible outline of the motorcycle is shown by a thin line.

As shown in FIGS. 1-3, a second muffler 29 is arranged parallel and next to the first muffler 23 on the right side (in the vehicle width direction) of the center line CL. The second muffler 29 includes a second muffler chamber 30 formed therein.

A side wall portion of the second muffler 29 is close to a portion of an opposite side wall of the first muffler 23. The second muffler chamber 30 of the second muffler 29 is longer than the first muffler chamber 24 of the first muffler 23 in a longitudinal direction thereof (and in a longitudinal direction of the vehicle body).

In an assembled state, a front portion 29*a* of the second muffler 29 (the second muffler chamber 30) is located in front of a front end portion of the first muffler 23 and the rear portion 29*b* of the second muffler 29 is located at rear of a rear end portion of the first muffler 23.

A communicating pipe 28 is dispose between the first muffler 23 and the second muffler 29, and connects opposite walls of the rear of an intermediate portion of the second muffler 29 and the rear portion of the first muffler 23. The first muffler chamber 24 communicates with the second muffler chamber 30 via the first communicating pipe 28.

The second muffler chamber 30 is partitioned into a front chamber 32 and a rear chamber 33 by a partition plate 31 disposed in the intermediate portion of the second muffler chamber 30. Both the front and rear chambers 32, 33 of the second muffler chamber communicate with each other via a second communicating pipe 34 disposed in the partition plate 31 connecting the front and rear chambers 32, 33.

A silencer 35 is installed in the rear chamber 33 in the longitudinal direction of the second muffler 29. A front end (an upstream end) portion 35*a* of the silencer 35 pierces the partition plate 31 and communicates with the front chamber 32, and a rear end (a downstream end) portion 35*b* thereof is opened rearwardly through a rear end plate 29*c* of the second muffler 29.

Exhaust gas from the first muffler chamber 24 flows into the rear chamber 33 of the second muffler chamber 30 through the first communicating pipe 28, and further flows into the front chamber 32 through the second communicating pipe 34. The exhaust gas flowing into the front chamber 32 further flows into the upstream end 35*a* of the silencer 35 and is emitted into the air (outside the engine) from the downstream end 35*b* of the silencer 35.

As described above, the first muffler chamber 24 is shorter in the longitudinal direction compared to the second muffler chamber 30. In other words, the second muffler chamber 30 is longer in the longitudinal direction, compared to the first muffler chamber. The first muffler chamber 24 and the second muffler chamber 30 are arranged closely to the right and left in the vehicle width direction, respectively.

As shown in FIG. 3, in an illustrative embodiment, a mounting bracket 36 is provided on a top outer surface of the first muffler 23. Mounting brackets 37, 38 are provided on a top outer surface of the second muffler 29. The mounting brackets 37, 38 are separated from each other in the longitudinal direction. Further, a mounting piece 39 is on an outer front end portion of the second muffler 29.

The arrangement of the exhaust system 20 of the present invention is described below.

FIG. 2 is a schematic plan view showing the motorcycle having the exhaust system according to the present invention. In FIG. 2, the exhaust system is shown in a thick full line, and a visible outline of the motorcycle is shown in a thin line.

The exhaust system 20 is arranged below the engine 6 (FIG. 1). When viewed in a side view, the inlets 21*a* of the four exhaust pipes 21 are connected to the exhaust ports 6*b* open in the front of each cylinder 6*a* of the engine 6, and the front halves 21*b* are extended downwardly in front of the engine. The exhaust pipe 21A is located on the rightmost side in the vehicle width direction as shown in FIG. 2, while the exhaust pipe 21D is located on the leftmost side in the vehicle width direction.

The downstream portion of the exhaust pipes 21, the junction pipes 22, the first muffler 23 forming the first muffler chamber 24 and the second muffler 29 forming the second muffler chamber 30 are arranged below a crankcase 6*c* of the engine 6, and below a transmission case connected to a rear portion of the crankcase.

In an embodiment, rear halves of the first muffler 23 and the second muffler 29 are extended further rearwardly below the engine, the rear end 35*b* of the silencer 35 protruding rearwardly from the second muffler 29 is located at the rear of the pillion step 12 (FIG. 1). Accordingly, an uncomfortable effect which hot exhaust gas may have on a passenger is prevented.

As shown in FIG. 2, when viewed in a top plan view, the first muffler 23 (the first muffler chamber 24) and the second muffler 29 (the second muffler chamber 30) of the exhaust system 20 are arranged in the vehicle width direction of the motorcycle 1. The first and second muffler chambers 24, 30 do not protrude beyond an outer periphery of motorcycle in the vehicle width direction.

The first and second muffler chambers 24, 30 are arranged parallel to each other such that first muffler chamber is disposed on the left side while the second muffler chamber is disposed on the right side in the vehicle width direction. In other words, a substantial portion of the first muffler 23 is disposed on a left side in the vehicle width direction, whereas a substantial portion of the second muffler 29 is disposed on a right side in the vehicle width direction, and the first muffler 23 and the second muffler 24 are arranged such that they are (or at least portions thereof) substantially parallel to each other.

The first muffler 23 (the first muffler chamber 24) is shorter in the longitudinal direction compared to the second muffler 29. In other words, the second muffler 29 (the second muffler chamber 30) is longer in the longitudinal direction compared to the first muffler 23. The first muffler 23 and the second muffler 29 are distributively arranged on the left side and on the right side of the center line CL, respectively. The center line is perpendicular to the vehicle width direction.

In the FIG. 4, flow of the exhaust gas from the engine 6 to the silencer 35, and to the outside the exhaust system into the atmosphere is shown by arrows.

Exhaust gas exhausted from the exhaust ports 6*b* of the cylinders 6*a* of the engine 6 flows into the exhaust pipes 21, then enters the exhaust gas guidance section 25 via the junction pipes 22, and further flows into the first muffler chamber 24 via the catalyst 27 disposed in the widened section 25*c* of the exhaust gas guidance section 25.

Further, the exhaust gas from the first muffler chamber 24 flows into the rear chamber 33 (partitioned by the partition plate 31) of the second muffler chamber 30 through the first communicating pipe 28 as shown by the arrow, and further flows into the front chamber 32 of the second muffler chamber 30 via the second communicating pipe 34.

The exhaust gas flowing into the front chamber 32 flows into the silencer 35 as shown by the arrow and is emitted into the air from the rear end (the downstream end) 35*b* of the silencer 35.

INDUSTRIAL AVAILABILITY

The exhaust system according to the present invention is suitable for a motorcycle having a multi-cylinder engine with a large displacement capacity. However, the disclosed exhaust system may be applied to an engine of other vehicles, such as an all-terrain vehicle.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An exhaust system for a motorcycle having a frame, front and rear wheels operatively supported on the frame, a vehicle body operatively supported on the frame, and an engine operatively supported on the frame and arranged between said front and rear wheels, the engine having exhaust ports formed therein and connected to respective exhaust pipes extending respectively therefrom for emitting exhaust gas outside the engine via a silencer operatively connected to the exhaust pipes, said exhaust system comprising:

a first muffler chamber situated between the engine and the rear wheel at a position below the engine, wherein said exhaust pipes extending from the exhaust ports of the engine converge in the first muffler chamber; and the exhaust gas from the engine flows into the first muffler chamber via said exhaust pipes;

a second muffler chamber arranged substantially parallel to the first muffler chamber in a vehicle width direction at a position below the engine, including a partition plate that divides the second muffler chamber into a front chamber and a rear chamber, and a communication pipe that pierces the partition plate to allow for airflow communication between the front and rear chamber;

a joining pipe extending from a rear portion of the first muffler chamber to the rear chamber of the second muffler chamber; and the silencer situated in rear chamber of the second muffler chamber and extending in a longitudinal direction of a vehicle body with a front end thereof piercing the partition plate and extending into the front chamber of the second muffler chamber, wherein the exhaust gas from the second muffler chamber flows into the silencer, and the exhaust gas is emitted outside the engine via the silencer wherein:

the exhaust gas from the first muffler chamber flows through the joining pipe into the second muffler chamber in the vehicle width direction;

the second muffler chamber is configured and arranged such that the exhaust gas received in the second muffler chamber flows in a forward direction therein substantially along the longitudinal direction of the vehicle body, is then turned back in the longitudinal direction of the second muffler chamber at a front inside portion thereof, and then flows rearwardly in the longitudinal direction of the vehicle body;

the silencer is configured and arranged such that the exhaust gas which flows rearwardly in second muffler chamber is received by said silencer in the longitudinal direction at a front portion thereof; and the exhaust gas is emitted outside the exhaust system from a rear portion of the silencer; and a front end of the second muffler is disposed forward of a front end of the first muffler and a rear end of the second muffler is disposed rearward of a rear end of the first muffler.

2. The exhaust system for a motorcycle according to claim 1, further comprising a catalyst; wherein said exhaust pipes are inserted into the first muffler chamber and converge therein forming an exhaust gas guidance section; and wherein said catalyst is arranged in said exhaust gas guidance section.

3. The exhaust system for a motorcycle according to claim 1, wherein the first muffler chamber and the second muffler chamber are arranged distributively at the left and right sides, respectively, in the vehicle width direction, in relation to a center line of the motorcycle extending in the longitudinal direction.

4. The exhaust system for a motorcycle according to claim 1, wherein the first muffler chamber and the second muffler chamber are arranged distributively at the left and right sides, respectively, in the vehicle width direction, in relation to a center line of the motorcycle extending in the longitudinal direction, such that mass of the exhaust system is substantially centralized on the motorcycle.

5. The exhaust system for a motorcycle according to claim 1, wherein substantial portions of the exhaust pipes are situated on said left side of the center line.

6. The exhaust system for a motorcycle according to claim 1, wherein the engine comprises a crankcase, and wherein the first muffler chamber and the second muffler chamber are arranged below the crankcase.

7. The exhaust system for a motorcycle according to claim 1, wherein the joining pipe extends through a sidewall of the second muffler at a position rearward of the partition plate.

8. An exhaust system for a motorcycle having a multi-cylinder engine, said exhaust system comprising:

a plurality of exhaust pipes having upstream end portion thereof operatively connected with respective one of exhaust ports of the engine;

a plurality of junction pipes, wherein an upstream end portion of each of said junction pipes is connected with downstream end portion of at least one of said exhaust pipes;

a first muffler having a first muffler chamber formed therein, said first muffler chamber connected to a downstream portion of the said junction pipes;

a second muffler having a second muffler chamber formed therein, a partition plate that divides the second muffler chamber into a front chamber and a rear chamber, and a communication pipe that pierces the partition plate to allow for airflow communication between the front and rear chamber;

a first communicating pipe disposed between a rear portion of said first muffler chamber and the rear chamber of said second muffler chamber; and a silencer disposed in the second muffler chamber;

wherein a front end of the second muffler is disposed forward of a front end of the first muffler and a rear end of the second muffler is disposed rearward of a rear end of the first muffler;

said first muffler chamber is situated between the engine and a rear wheel of the motorcycle at a position below the engine on a left side of a center line of the motorcycle defined along a longitudinal direction of the motorcycle; and said second muffler chamber is arranged substantially parallel to the first muffler chamber on a right side of the center line.

9. An exhaust system for a motorcycle according to claim 8, wherein said first muffler chamber includes an exhaust gas guidance section connected to said downstream portion of said junction pipes.

10. An exhaust system for a motorcycle according to claim 9, further comprising a catalyst disposed in said exhaust gas guidance section.

11. An exhaust system for a motorcycle according to claim 8, wherein said silencer is disposed in the rear chamber of the second muffler chamber.

12. An exhaust system for a motorcycle according to claim 8, wherein:

the exhaust gas from a rear portion of the first muffler chamber flows into the second muffler chamber in the vehicle width direction via said first communicating pipe;

the exhaust gas received by the second muffler chamber from said first muffler chamber flows from the rear chamber to the front chamber via said second communicating pipe in a forward direction substantially along the longitudinal direction of the motorcycle; and the exhaust gas received in the front chamber is turned back at a front inside portion thereof, which subsequently flows rearwardly in the longitudinal direction of the motorcycle and is emitted outside the exhaust system via a rear portion of said silencer.

13. A motorcycle comprising a multi-cylinder engine disposed between a front and rear wheels of the motorcycle; said said engine having exhaust ports formed therein;

a plurality of exhaust pipes having upstream end portion thereof operatively connected with respective one of exhaust ports of the engine;

a plurality of junction pipes, wherein an upstream end portion of each of said junction pipes is connected with downstream end portion of at least one of said exhaust pipes;

a first muffler having a first muffler chamber formed therein, said first muffler chamber connected to a downstream portion of the said junction pipes;

a second muffler having a second muffler chamber formed therein, a partition plate that divides the second muffler chamber into a front chamber and a rear chamber, and a communication pipe that pierces the partition plate to allow for airflow communication between the front and rear chamber;

a first communicating pipe disposed between a rear portion of said first muffler chamber and the rear chamber of said second muffler chamber; and a silencer disposed in the second muffler chamber;

wherein a front end of the second muffler is disposed forward of a front end of the first muffler and a rear end of the second muffler is disposed rearward of a rear end of the first muffler;

said first muffler chamber is situated between the engine and a rear wheel of the motorcycle at a position below the engine on a left side of a center line of the motorcycle defined along a longitudinal direction of the motorcycle; and said second muffler chamber is arranged substantially parallel to the first muffler chamber on a right side of the center line.

14. A motorcycle according to claim 13, wherein said first muffler chamber includes an exhaust gas guidance section connected to said downstream portion of said junction pipes.

15. A motorcycle according to claim 14, further comprising a catalyst disposed in said exhaust gas guidance section.

16. A motorcycle according to claim 13, wherein said silencer is disposed in the rear chamber of the second muffler chamber.

* * * * *